US009421607B2

(12) United States Patent
Rossi et al.

(10) Patent No.: US 9,421,607 B2
(45) Date of Patent: Aug. 23, 2016

(54) CONTINUOUS CASTING OF LEAD ALLOY STRIP FOR HEAVY DUTY BATTERY ELECTRODES

(71) Applicant: MITEK HOLDINGS, INC., Wilmington, DE (US)

(72) Inventors: Jeffrey A. Rossi, Toronto (CA); Theodore J. Seymour, Freelton (CA)

(73) Assignee: MITEK HOLDINGS, INC., Wilmington, DE (US)

( * ) Notice: Subject to any disclaimer, the term of this patent is extended or adjusted under 35 U.S.C. 154(b) by 252 days.

(21) Appl. No.: 13/967,099

(22) Filed: Aug. 14, 2013

(65) Prior Publication Data

US 2014/0048226 A1 Feb. 20, 2014

Related U.S. Application Data

(62) Division of application No. 12/926,266, filed on Nov. 5, 2010, now Pat. No. 8,701,745.

(60) Provisional application No. 61/272,811, filed on Nov. 6, 2009.

(51) Int. Cl.

| | |
|---|---|
| ***B22D 11/06*** | (2006.01) |
| ***B22D 25/04*** | (2006.01) |
| ***C22C 11/08*** | (2006.01) |

(52) U.S. Cl.

CPC ..... *B22D 11/0682* (2013.01); *B22D 11/064* (2013.01); *B22D 11/0611* (2013.01); *B22D 25/04* (2013.01); *C22C 11/08* (2013.01)

(58) Field of Classification Search

CPC ..... B22D 11/0611; B22D 11/064; B22D 11/0682; B22D 25/04; C22C 11/00; C22C 11/08

USPC ..... 164/423, 427, 429, 479, 463

See application file for complete search history.

(56) References Cited

U.S. PATENT DOCUMENTS

| | | | |
|---|---|---|---|
| 4,629,516 | A | 12/1986 | Myers |
| 4,955,429 | A | 9/1990 | Honeycutt, III et al. |

(Continued)

FOREIGN PATENT DOCUMENTS

| | | |
|---|---|---|
| GB | 2250856 A | 6/1992 |
| RU | 2273545 C2 | 4/2006 |
| UA | 32571 U | 5/2008 |

OTHER PUBLICATIONS

Russian Decision to Grant for Application No. 2012123385/02 dated Jul. 7, 2014, 19 pages, Moscow, Russia. (with English translation).

European Extended Search Report for Application No. 10827759.1, Nov. 13, 2014, 6 pages.

(Continued)

*Primary Examiner* — Kevin P Kerns

(74) *Attorney, Agent, or Firm* — Senniger Powers LLP

(57) ABSTRACT

An apparatus for direct casting of strip from a pool of molten metal includes a tundish having a feed chamber, a return chamber and a diverting chamber. A lip insert is inserted into the tundish and has an open front for cooperation with a casting surface. The apparatus includes a control mechanism configured to control the surface level of the pool of molten metal in the diverting chamber and in the lip insert, and a movement mechanism configured to move the casting surface upwardly through the pool of molten metal for the casting of metal on the casting surface. The casting surface is an aluminum surface of a cylindrical drum and has a coarse irregular surface formed thereon by biasing with crushed, angular silicon carbide or aluminum silicate.

20 Claims, 3 Drawing Sheets

(56) References Cited

U.S. PATENT DOCUMENTS

| | | | | |
|---|---|---|---|---|
| 5,083,603 | A * | 1/1992 | Heurtault | B22D 11/0622 164/463 |
| 5,462,109 | A | 10/1995 | Vincze et al. | |
| 5,948,566 | A | 9/1999 | Larsen et al. | |
| 8,701,745 | B2 * | 4/2014 | Rossi | B22D 11/0611 164/463 |
| 2009/0145567 | A1 | 6/2009 | Eastman | |

OTHER PUBLICATIONS

PCT International Search Report and Written Opinion for PCT/CA2010/001765 dated Feb. 2, 2011, 8 pages.
Russian Notification for Application No. 2012123385/02(035572) dated Dec. 9, 2013, 3 pages, Moscow, Russia. (with English translation).
European Communication for Application No. 10827759.1, Jan. 4, 2016, 4 pages.

* cited by examiner

CONTINUOUS CASTING OF LEAD ALLOY STRIP FOR HEAVY DUTY BATTERY ELECTRODES

CROSS-REFERENCE TO RELATED APPLICATIONS

This application is a divisional of U.S. Ser. No. 12/926,266, filed Nov. 5, 2010, issued Apr. 22, 2014, as U.S. Pat. No. 8,701,745, which is a nonprovisional of U.S. Ser. No. 61/272,811, filed Nov. 6, 2009, the entire contents of which are incorporated herein by reference.

BACKGROUND OF THE INVENTION (i) Field of the Invention

This invention relates to a method and apparatus for continuous casting of molten lead alloys as strip and, more particularly, to high speed continuous casting of thick lead alloy strip.

(ii) Description of the Related Art

Battery electrodes meant for service in industrial, motive power, and/or telecomm batteries are typically made using a book moulding procedure, i.e. gravity casting. Book moulding is a means to solidify molten lead directly into a thick battery electrode, wherein the molten lead is fed into a steel mould, solidified, and released.

Thick positive battery grids made by gravity casting methods have a porous and non-uniform micro-structure which promotes corrosion, can be subject to grid growth, and cause high water loss in a battery. All these characteristics shorten the battery life. The gravity casting method, however, is the only method that is used on a commercial scale to make positive low antimony grid electrodes.

U.S. Pat. No. 5,462,109 granted to Cominco Ltd. (Now Teck Metals Ltd.), incorporated herein by reference, discloses a method and apparatus for continuously casting a lead alloy strip, including antimony strip. The strip is cast on a chilled, pebbled casting surface of a rotating drum from a pool of the molten metal contained in a tundish having a graphite lip insert seated therein cooperating with the casting surface adjacent to the tundish to form and contain the pool of the molten metal. A preferred lead alloy is an antimony-lead alloy containing up to 4.0 wt % antimony which is cast into strip and is subjected to a heat treatment to provide integrity and strength necessary to permit subsequent production of expanded mesh battery grids. The battery grids produced by this method have improved electrochemical properties such as corrosion resistance and resistance to growth. However, although thin and narrow antimony-lead alloy strip can be produced at low speeds of 36-38 feet/minute in a thickness in the range of 0.02" to 0.06" and in widths up to five inches, it has been found that both thin and thick low antimony lead strip continuously cast on a commercial high speed basis for use as positive electrodes suffered from the formation of longitudinal cracks in the direction of casting during the solidification process particularly at increased casting speeds.

It is a principal object of the present invention therefore to provide a method and apparatus for continuously casting antimony lead alloy strip, particularly thick antimony lead strip, having up to and in excess of 5 wt % antimony, for industrial use, having an acceptable fine grain structure, essentially no porosity and high corrosion resistance.

It is another object of the invention to provide a method and apparatus for casting wide lead alloy strip in widths up to 20 inches which can be readily controlled for desired strip thickness from thin to thick strip ranging in thickness up to and above 0.185 inch and which allows for a wide selection of lead alloys, including lead alloys of antimony and calcium.

A further object of the invention is the provision of a method and apparatus which permits continuous high speed commercial casting of lead alloys into strip suitable for producing electrodes for heavy duty, industrial, motive power, telecomm, renewable energy, uninterruptible power supply and the like batteries.

SUMMARY OF THE INVENTION

We have found surprisingly that abrading the casting surface of a drum in a tundish casting apparatus having a lip insert with an angular sand blasting material such as crushed silicon carbide or aluminum silicate to create a coarse textured surface, increasing the height of the tundish and the lip insert to permit an increase in the depth of a pool of molten metal adjacent the casting surface and hence residence time of the molten metal against the casting surface, controlling the rate of cooling of cast metal, and increasing the wrap around the drum casting surface to increase residence time of the cast metal on the casting surface, results in a three-fold increase of strip thickness of up to 0.185 inch and more without formation of longitudinal cracks in thick strip of lead alloys containing up to and in excess of 5 wt % antimony cast at commercial high speeds of up to 135 feet per minute.

In its broad aspect, the method of the invention for continuously casting a lead alloy on a casting surface of a rotating drum from a pool of molten lead alloy comprises imparting a coarse texture to the casting surface by abrading the surface of the drum with an angular sand material typified by crushed silicon carbide to provide the coarse texture to the casting surface, providing a tundish containing the pool of molten lead alloy adjacent a substantial portion of an upper quadrant of an upwardly moving portion of said rotating drum, said tundish having a rear wall, side walls and an open front in proximity to the casting surface, removably attaching in said tundish adjacent said open front a graphite lip insert having a floor and opposed tall sidewalls adapted to fit with the tundish side walls and open front, said graphite lip insert having an open front defined by the lip insert floor and lip insert sidewalls cooperating with and commencing at a substantially vertical, portion of the casting surface to contain said molten lead alloy in the lip insert, continuously supplying molten lead alloy to the pool of molten lead alloy from a bath of molten lead alloy maintained at a temperature in the range of 575° to 750° F., providing means for raising and lowering the height of the pool of the molten lead alloy for increasing the height of the molten lead alloy pool for producing thick cast strip and lowering the height of the molten lead alloy pool for producing thin cast strip, controlling the temperature of the lead alloy in the lip insert at a temperature in the range of about 640° to 750° F., moving the casting surface upwardly through the pool of molten lead alloy by rotating said drum for depositing lead alloy thereon, cooling the casting surface of the drum to a temperature in the range of about 100° to 210° F. to solidify a strip of said molten alloy thereon, and stripping the strip from the casting surface.

More particularly, the method of the invention comprises continuously casting thick, fine-grained lead antimony alloy strip having essentially no porosity on a casting surface on substantially the upper half of a rotatable casting drum from a pool of molten lead antimony alloy containing about 0.5 wt % to 6.0 wt % antimony, preferably about 3 wt % to 5 wt % antimony, the balance essentially lead, imparting a coarse texture to the casting surface, providing a tundish containing a pool of said molten lead alloy, at a temperature in the range of about 570° to 590° F. from a bath of molten antimony-lead alloy maintained at a temperature in the range of 575° to 750° F., preferably 590° to 650° F. adjacent a substantial portion of an upper quadrant of an upwardly-moving casting drum said tundish having an open front in proximity to the casting surface, removably attaching a graphite lip insert having a floor and opposed tall sidewalls adapted to fit the tundish sidewalls and open front, said graphite lip insert having an open front defined by the lip insert floor and opposed sidewalls cooperating with and commencing at a substantially vertical portion of the casting surface to contain said molten lead alloy in the lip insert, controlling the height of the surface level of the molten lead alloy in the lip insert to produce a strip of desired thickness, moving the casting surface upwardly through the pool of molten lead alloy by rotating said drum for depositing the lead alloy thereon, controlling the temperature of the antimony-lead alloy in the lip insert at a temperature in the range of about 640° to 700° F. preferably about 680° to 685° F., cooling the molten lead alloy on substantially the upper half of the rotatable casting drum at a temperature in the range of 175° to 210° F., preferably 180° to. 195° F., to solidify a strip of said molten lead alloy on the casting surface, and stripping the strip from the casting surface.

The drum casting surface preferably is a water-cooled aluminum alloy. The lead antimony alloy preferably comprises about 3 wt % to 5 wt % antimony, up to about 2 wt % tin, up to about 0.03 wt % silver, and the balance essentially lead.

BRIEF DESCRIPTION OF THE DRAWINGS

The invention will now be described with reference to the accompanying drawings, in which.

DETAILED DESCRIPTION OF THE PREFERRED. EMBODIMENT

Figure 1:
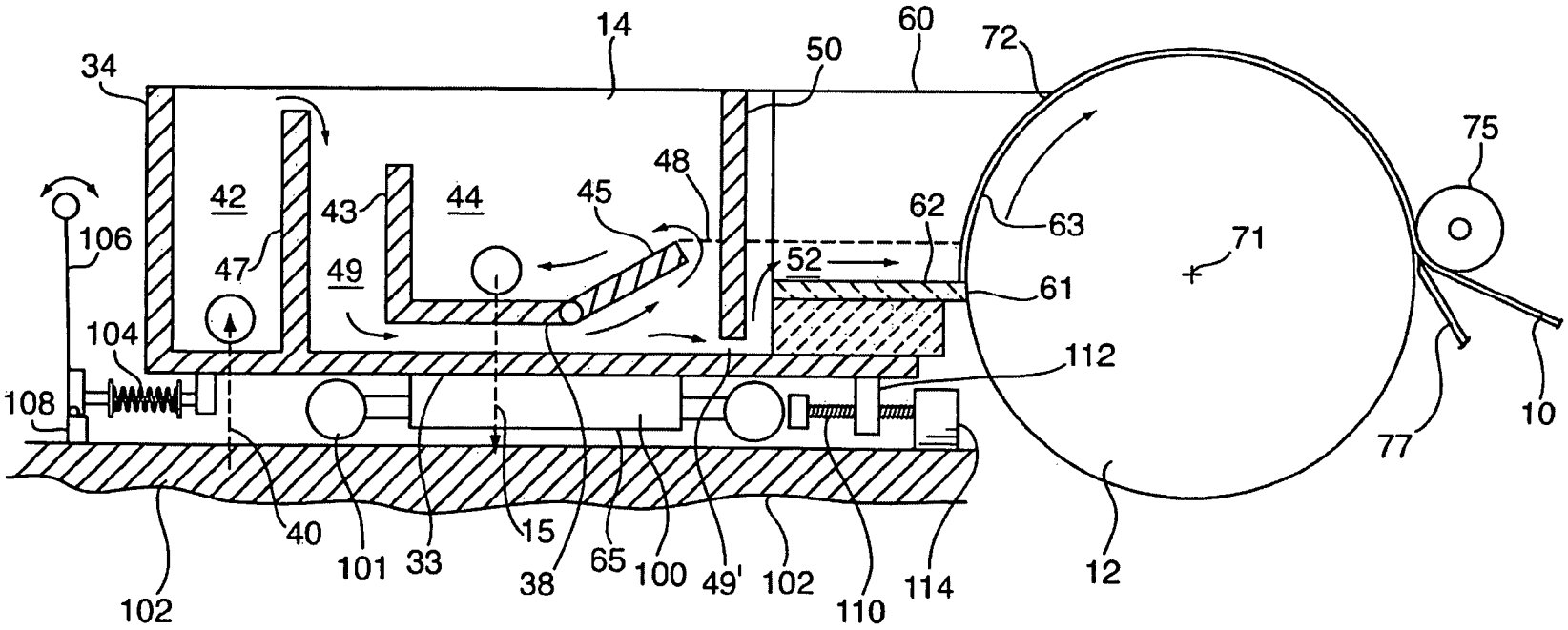
FIG. 1 is a longitudinal sectional view of the tundish, lip insert and casting drum of the invention.

Strip for making grids for positive electrodes for lead-acid batteries can be successfully cast in accordance with the method of the present invention, to be described, from wide-freezing range lead alloys. These alloys include low antimony-lead alloys. Although the following detailed description is with reference to low antimony-lead alloys, it will be understood that the method of the present invention is equally well suitable for the casting of strip metal such as pure lead, calcium-lead and other lead alloys.

The antimony-lead alloys for low-maintenance batteries may contain as little as 0.5% to up to about 5% Sb by weight. This is the broadest range of antimony contents that is generally considered suitable for automotive batteries. For maintenance-free batteries, the alloys contain antimony in the range of about 1% to 3% Sb by weight. Below about 1% Sb in battery grids, the antimony content is too low and batteries lose the characteristics necessary for cycling. Above about 2% Sb in the battery grid, the batteries normally exhibit high gas evolution. However, the fine grain structure of the product of the present invention makes it possible to use antimony contents of up to about 5% and higher without a marked increase in gassing, 3% Sb being particularly suited for negative electrodes and 5% Sb for positive electrodes based on commercial alloys commonly used in the industry. The antimony content of the alloys of the present invention is, therefore, in the range of about 0.3% to 5.05% Sb.

The antimony-lead alloys may additionally contain one or more alloying elements such as tin up to 2 wt %, silver up to 0.03 wt %, and arsenic, copper, selenium, tellurium, cadmium, bismuth, magnesium, lithium or phosphorous, each present in the range of about 0.001% to 0.5% by weight. These elements may be present as impurities or added for a variety of reasons. Although the various antimony-lead alloy compositions without additional alloying elements can be successfully cast using the method of the invention, it is preferred to add an amount of arsenic and an amount of tin to the antimony-lead alloy to improve the castability and fluidity of the alloy, which increases productivity, and to improve the characteristics of the cast strip. The amount of arsenic preferably is in the range of about 0.1% to 0.2% by weight, and the amount of tin preferably is in the range of about 0.2% to 0.7% by weight, of the alloy.

Selenium typically is required to acquire a desired fine-grain structure, but is difficult to dissolve in the molten metal bath. We have found, that no grain-refining elements such as, for example, copper, selenium or sulfur need to be added. As will be explained in more detail, the method of the present invention causes the cast alloy strip to have an inherent fine grain structure and other superior characteristics including essentially zero porosity. It is, however, understood that an alloy containing these grain refiners can be successfully cast using the method of the invention.

FIG. 1 shows schematically the casting drum 12 and tundish 14. The tundish 14 is defined by a horizontal bottom 33, an endwall 34, and, two parallel sidewalls 35, 36. The tundish has an inlet up-spout 40 for the introduction of molten lead alloy from a molten bath adjacent the tundish to feed chamber 42 defined by endwall 34 and turbulence plate 47. Molten lead alloy passes over a weir defined by the top of turbulence plate 47 into diverting chamber 49. A portion of the molten lead alloy is diverted to return chamber 44 which is defined by wall 43, floor 38, and adjustable weir 45. Adjustable weir 45, hingely attached to return chamber floor 38, controls the surface height of molten lead alloy, as depicted by numeral 48. Gap 49' defined between floor 38 and the lower edge of vertical baffle 50 allows molten lead alloy to flow into casting chamber 52 to a height equal to height 48 in chamber 49. Lip insert structure 60, secured to tundish 14, has a base floor 62 and parallel sidewalls 64, 66 to define the floor and sides of casting chamber 52, sidewalls 64, 66 preferably being of the same height as tundish sidewalls 35, 36. The rear of chamber 52 is defined by vertical baffle 50 and the front thereof is defined by drum 12 extending upwardly from front edge 61 of the floor 62 of insert 60. Lip insert 60 preferably is machined from graphite.

Figure 2:
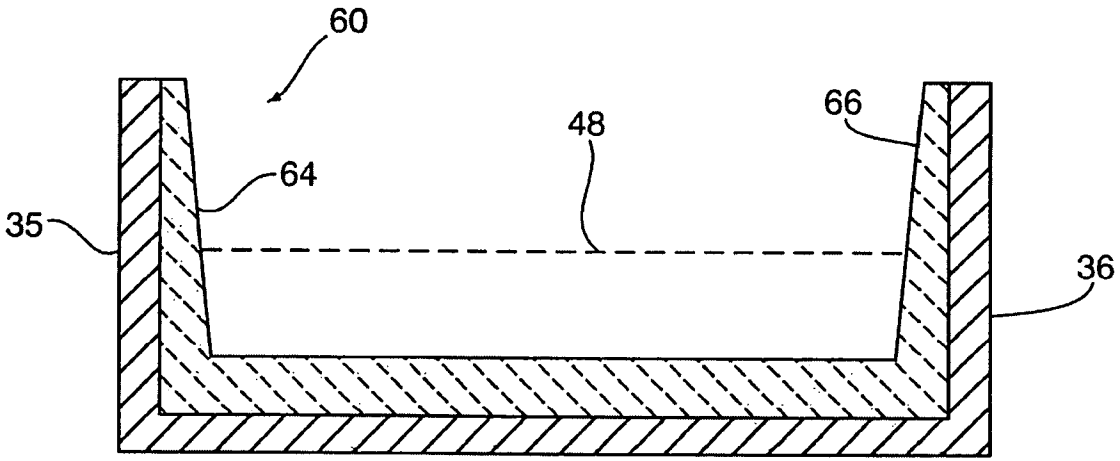
FIG. 2 is a transverse sectional view of the lip insert shown in FIG. 1.

With reference now to FIG. 2, lip insert structure 60, removably attached to the tundish, has tall sidewalls 64, 66 preferably at the same height as tundish sidewalls 35, 36 with opposed interior surfaces preferably sloping upwardly and outwardly away from the melt. These sloping sidewalls give relief to the solidifying edges of the metal alloy being cast to a strip.

With reference again to FIG. 1, the casting drum 12 is rotatable around a horizontal axis 71. The outer circumferential surface 72 of drum 12 is conditioned by treating with an angular abrading medium such as by blasting with angular silicon carbide particles rather than conventional glass beads to provide a coarse and irregular surface texture. Although it will be understood that we are not bound by theoretical considerations, it is believed that the coarse and irregular surface texture, compared to a conventional, pebbled surface, increases the thermal resistance at the interface between the cast metal and the drum surface to reduce the rate of heat transfer and slow down cooling at the surface of the strip, thereby reducing stress and eliminating cracking of the strip while providing a fine grain structure with essentially no porosity. The exterior casting surface of the drum preferably is a shell formed of an aluminum alloy which is readily abraded to provide the necessary rough and coarse texture to impede heat transfer. The casting surface is cooled by a flow of cooling water circulating through a 0.20 inch wide annulus (not shown) formed under the casting surface.

The rotatable drum may also be supplemented with a secondary drum 75 at about the "three o'clock" position, to increase residence time of the strip on drum 12 on substantially the upper half of drum 12, and a sharp scraper plate 77 adjacent the nip of drum 75 with drum 12 to peel strip 10 off the drum at start-up. Scraper plate 77 is spaced about 0.010 inches from the surface of drum 12. Secondary roll 75 may also have cooling water to supplement cooling of the strip. The diameter of the drum 12, its rotational speed, the height of the lip insert walls and hence the height of the surface level 48 of the pool of molten lead alloy, the finish texture and the temperature of the outer surface 72 of the drum, and the temperatures of the melt in the tundish and in the lip insert, determine the amount of melt which is dragged onto the outer surface 72 on substantially the upper half of the drum from the bath of molten metal in the tundish, thereby determining the thickness of the strip. The cooled drum surface 72, having a temperature corresponding to the temperature of the cooling water and supplemented by secondary cooling drum 75 if desired, controls the rate of freezing solidification of the molten metal into a strip 10 of fine grain structure and of substantially constant width and thickness during the residence time of the cast strip on the upper quadrant of the drum.

The cooling water in casting drum 12 is maintained in the temperature range of 175° to 210° F., preferably 180° to 195° F., during steady-state continuous casting of antimony-lead alloys.

The molten metal alloy flows from a holding vessel (not shown) having a molten bath maintained at a bath temperature in the range of 575° to 750° F., preferably at 590° to 625° F. for antimony-lead alloys and up to 750° F. for calcium-lead alloys, via a molten-metal centrifugal pump (not shown) through the up-spout 40 into the feed chamber 42 and over the weir defined by turbulence plate 47 into the diverting chamber 49. At the end of the diverting chamber 49, the metal flow is diverted into the two flows: one upwardly over the adjustable weir 45 into the return chamber 44, and the other through control gap 49'. The molten metal alloy flowing over the adjustable overflow weir 45 flows into return chamber 44 and then into a holding vessel for molten alloy by way of downspout 15. The surface level 48 is controlled by the adjustable overflow weir 45 to ensure the proper surface level of the molten metal in chamber 52 at drum 12. The molten metal is pumped into tundish inlet chamber 42 at a rate to ensure that the molten metal is always in excess and continually flows over the weir 45 into return chamber 44, thereby stabilizing the molten metal temperature to avoid freezing. Any slag that may be formed or is contained in the molten metal separates easily from the melt in the tundish between turbulence plate 47 and return chamber wall 43. The adjustable weir 45, the flow control baffle 50 and the control gap 49' effectively control the amount, the surface level 48 and, in combination with turbulence plate 47, the turbulence of the molten metal in the tundish. A substantially quiescent flow of molten metal with a substantially constant depth (thickness) is now presentable to the rotatable drum 12.

In presenting the molten metal to the drum surface 72, the lip insert structure 60 and the drum-abutting surface 61 thereof must be of the proper design and in the proper position. The lip insert structure 60 design must ensure that there are no obstructions that could cause the solidifying metal to bind to the lip insert during casting. The sides 64, 66 of the lip insert 60 thus are sloped upwardly and outwardly away from the molten metal. The edges 61 and 63 of the lip structure 60 abutting drum 12 must be contoured to match the exact curvature of the drum surface 72. The position of the lip edges 63 are positioned in close proximity to the drum surface 72 at about the "nine to eleven o'clock" position. The edges 61 and 63 do not touch the drum surface 72 as the molten metal is transferred from the lip structure 60 to the drum surface 72. However, too much space between the edges 61 and 63 and the drum surface 72 results in a spillout of the molten metal and termination of the cast. Adjusting means 65, such as a wheeled carriage 100 having support wheels 101 supporting tundish 14 on caster frame 102 and die compression spring 104 biasing the tundish to the right, as viewed in FIG. 1, is provided to rapidly and accurately move tundish 14 and lip insert 60 towards and away from drum 12 and its surface 72 to obtain proper positioning and correct space therebetween. Spring 104 is actuated by control lever 106 pivotally mounted on hinge base 108 to allow tundish to be urged to the right or allow the tundish to be retracted to the left. An adjuster screw 110 is threaded into bracket 112 on the underside of tundish 14 to abut stop projection 114 secured to caster frame 102 to finely adjust lip insert surface 63 in proximity to drum surface 72 under the bias of die spring 104.

A lip insert 60 made of graphite is particularly well-suited for this purpose in that the graphite is softer than the metal of drum surface 72 and lip surface 63 can readily be formed for close conformity with drum surface 72 by wrapping sand paper about drum surface 72 and abutting surface 63 against drum surface 72 while the casting drum is rotated. In addition, graphite is well-suited in that it is not easily wetted by the molten metal. Electric heaters (not shown) embedded in the lip insert adds supplementary heat as necessary to the molten alloy to maintain the desired lip melt temperature.

As the rotatable drum 12 is rotated, a predetermined amount of molten alloy is dragged onto its casting surface 72. The metal alloy solidifies to form strip 10 which usually leaves the drum at about the "three o'clock" position as determined by secondary drum 75 and scraper plate 77. Finished strip 10 is pulled from the rotating drum 12 by pull rollers which may form part of a slitting assembly (not shown). The pull rollers are driven by an adjustable speed motor which is adjusted to the rotation of drum 12 to achieve and preferably continuously maintain a desired pulling tension on the strip as it is stripped from the casting surface and coiled on a torque-controlled wind-up mandrel (not shown).

We have found for antimony alloys of lead, the operating temperatures of the furnace, tundish, lip, and, drum cooling water are critical to producing satisfactory strip and stable operation. Initially, for start-up for antimony-lead alloys, the furnace is set high at about 720° F., ensuring a large amount of superheat, and then during casting the bath temperature lowered to about 570° to 650° F., preferably about 590° to 625° F., and for a lead alloy having 3 to 5% antimony, more preferably a, bath temperature of 600° to 615° F. is acceptable. The tundish temperature is set at 575° to 590° F. and the lip temperature is set at 640° to 700° F., preferably at 670° to 685° F. and more preferably at 680° to 685° F. for the duration of operation.

The invention will now be illustrated by the following non-limitative example.

Example

Antimony-lead alloys having 3 wt % and 5 wt % antimony, up to 2 wt % tin, up to 0.02 wt % silver, the balance lead were continuously cast in the apparatus of the invention in thicknesses ranging from 0.040" to 0.182" at production speeds ranging from 25 ft/min to 135 ft/min, depending on desired strip thickness and alloy composition. Tundish 14 and graphite lip insert 60 had side and end walls increased in height from 3.5 inches to 6.5 inches, an increase of 3 inches, allowing the molten lead alloy to remain at an increased height longer in contact with the cooled drum, permitting a thicker strip to solidify against the coarse-textured drum casting surface. The height of the molten alloy in the tundish and lip insert was controlled by the weir assembly 45 inside the tundish, permitting casting of thin strip as well as thick strip.

The casting drum had a diameter of 12 inches and rotated at 8 to 43 RPM, dependent on desired production speed.

Initially, for start-up, the furnace was set high at about 720° F. ensuring a large amount of superheat, and then the bath temperature lowered to the range of 590° to 650° F. during casting. For a lead alloy having 3 to 5% antimony, a bath temperature of 590° to 615° F. was acceptable. The tundish temperature initially was set at 650° F. and lowered to 575° to 590° F. with good strip quality and the lip temperature was initially set at 735° F. and operated at 670° to 685° F., preferably 680° F. for the duration of operation. The cooling water temperature resided at 115° to 120° F. prior to casting and the temperature increased to 175° to 210° F. during casting, preferably about 180° to 195° F. during steady-state operation.

Table 1 shows the trial results of tests conducted on lead alloys having 3 wt % antimony and 5 wt % antimony at indicated casting speeds and bath, tundish, lip and cooling water temperatures.

TABLE 1

| Trial | Sb Amount | Speed (fpm) | Thickness (in) | Bath Temp (F.) | Tundish (F.) | Lip Temp (F.) | Water Temp (F.) | Results/Comments | Overall Strip Quality |
|---|---|---|---|---|---|---|---|---|---|
| 1 | 3% | 42 | 0.080 | 720 | 640 | 730 | 130 | Dull surface with white blotches, cracking on sides of strip | Not Acceptable |
| 2 | 3% | 45 | 0.082 | 720 | 650 | 735 | 128 | Cracking evident on all areas of strip, river pattern evident | Not Acceptable |
| 3 | 3% | 65 | 0.075 | 650 | 600 | 680 | 140 | Strip very brittle, edges falling apart, cracking evident on all areas of strip | Not Acceptable |
| 4 | 3% | 100 | 0.070 | 650 | 610 | 685 | 140 | Cracking on ends of strip evident - not consistent with rotation of drum (internal to strip) | Not Acceptable |
| 5 | 3% | 90 | 0.085 | 650 | 615 | 685 | 138 | Cracks on all areas of strip, especially edges | Not Acceptable |
| 6 | 3% | 90 | 0.095 | 625 | 585 | 640 | 170 | Upon startup, some cracking occurred, once steady state was reached, cracking subsided | Acceptable |
| 7 | 3% | 90 | 0.095 | 610 | 600 | 670 | 180 | Strip was allowed to cast back into furnace until steady state was achieved, then was started onto winder -- no cracking observed, strip visually good | Acceptable |
| 8 | 3% | 80 | 0.102 | 610 | 600 | 670 | 180 | No cracking | Acceptable |
| 9 | 3% | 70 | 0.115 | 610 | 600 | 670 | 180 | No cracking, good surface quality | Acceptable |
| 10 | 3% | 80 | 0.085 | 655 | 610 | 685 | 180 | Cracking was evident - all parameters same as before except for higher furnace temperature | Not Acceptable |
| 11 | 3% | 70 | 0.115 | 600 | 590 | 675 | 185 | Cracking observed initially, but subsided as cast continued and steady state was reached | Acceptable |
| 12 | 3% | 60 | 0.125 | 600 | 590 | 675 | 185 | No cracking, good surface quality | Acceptable |
| 13 | 5% | 45 | N/A | 650 | 610 | 680 | 130 | Strip could not enter slitter due to many cracks present (water likely too cold, bath likely too hot) | Not Acceptable |
| 14 | 5% | 80 | 0.090 | 615 | 580 | 680 | 195 | Casting was enabled by allowing strip to cast back into furnance until steady state was reached (i.e. furnace pre-heated to 685, water cold at 120 -- steady state furnace ~615, water ~195), no cracking observed after steady state achieved | Acceptable |

TABLE 1-continued

| Trial | Sb Amount | Speed (fpm) | Thickness (in) | Bath Temp (F.) | Tundish (F.) | Lip Temp (F.) | Water Temp (F.) | Results/Comments | Overall Strip Quality |
|---|---|---|---|---|---|---|---|---|---|
| 15 | 5% | 70 | 0.095 | 615 | 580 | 680 | 195 | No cracking, good surface quality | Acceptable |
| 16 | 5% | 60 | 0.100 | 615 | 580 | 680 | 195 | No cracking, good surface quality | Acceptable |
| 17 | 5% | 50 | 0.120 | 615 | 580 | 680 | 195 | No cracking, good surface quality | Acceptable |
| 18 | 5% | 70 | 0.100 | 620 | 605 | 680 | 200 | FINE blast used (same as on calcium casting) -- cracking observed | Not Acceptable |
| 19 | 5% | 90 | 0.085 | 620 | 605 | 680 | 200 | FINE blast used (same as on calcium casting) -- cracking observed | Not Acceptable |
| 20 | 5% | 70 | 0.105 | 600 | 580 | 680 | 190 | No cracking, good surface quality | Acceptable |
| 21 | 5% | 60 | 0.110 | 600 | 580 | 680 | 190 | No cracking, good surface quality | Acceptable |
| 22 | 5% | 50 | 0.115 | 600 | 580 | 680 | 190 | No cracking, good surface quality | Acceptable |
| 23 | 5% | 40 | 0.150 | 600 | 580 | 680 | 190 | No cracking, good surface quality | Acceptable |
| 24 | 5% | 70 | 0.085 | 615 | 590 | 680 | 200 | No cracking, good surface quality | Acceptable |
| 25 | 5% | 80 | 0.082 | 615 | 590 | 680 | 200 | No cracking, good surface quality | Acceptable |
| 26 | 5% | 90 | 0.075 | 615 | 590 | 680 | 200 | No cracking, good surface quality | Acceptable |
| 27 | 5% | 100 | 0.070 | 615 | 590 | 680 | 200 | No cracking, good surface quality | Acceptable |
| 28 | 5% | 110 | 0.068 | 615 | 590 | 680 | 200 | No cracking, good surface quality | Acceptable |
| 29 | 5% | 120 | 0.065 | 615 | 590 | 680 | 200 | No cracking, good surface quality | Acceptable |
| 30 | 5% | 135 | 0.062 | 615 | 590 | 680 | 200 | No cracking, good surface quality | Acceptable |
| 31 | 5% | 40 | 0.092 | 610 | 590 | 685 | 185 | No cracking, good surface quality | Acceptable |
| 32 | 5% | 50 | 0.085 | 610 | 590 | 685 | 185 | No cracking, good surface quality | Acceptable |
| 33 | 5% | 60 | 0.074 | 610 | 590 | 685 | 185 | No cracking, good surface quality | Acceptable |
| 34 | 5% | 70 | 0.067 | 610 | 590 | 685 | 185 | No cracking, good surface quality | Acceptable |
| 35 | 5% | 80 | 0.058 | 610 | 590 | 685 | 185 | No cracking, good surface quality | Acceptable |
| 36 | 5% | 90 | 0.053 | 610 | 590 | 685 | 185 | No cracking, good surface quality | Acceptable |
| 37 | 5% | 100 | 0.049 | 610 | 590 | 685 | 185 | No cracking, good surface quality | Acceptable |
| 38 | 5% | 110 | 0.046 | 610 | 590 | 685 | 185 | No cracking, good surface quality | Acceptable |
| 39 | 5% | 120 | 0.044 | 610 | 590 | 685 | 185 | No cracking, good surface quality | Acceptable |
| 40 | 5% | 135 | 0.042 | 610 | 590 | 685 | 185 | No cracking, good surface quality | Acceptable |
| 41 | 5% | 70 | 0.076 | 610 | 590 | 685 | 185 | No cracking, good surface quality | Acceptable |
| 42 | 5% | 80 | 0.070 | 610 | 590 | 685 | 185 | No cracking, good surface quality | Acceptable |
| 43 | 5% | 90 | 0.067 | 610 | 590 | 685 | 185 | No cracking, good surface quality | Acceptable |
| 44 | 5% | 100 | 0.059 | 610 | 590 | 685 | 185 | No cracking, good surface quality | Acceptable |
| 45 | 5% | 110 | 0.057 | 610 | 590 | 685 | 185 | No cracking, good surface quality | Acceptable |
| 46 | 5% | 120 | 0.054 | 610 | 590 | 685 | 185 | No cracking, good surface quality | Acceptable |
| 47 | 5% | 135 | 0.048 | 610 | 590 | 685 | 185 | No cracking, good surface quality | Acceptable |
| 48 | 5% | 25 | 0.180 | 612 | 590 | 680 | 180 | Strip was of good quality, and no cracking -- however slitter did not have enough power at the low strip speed to pull through -- need a more powerful slitter to continue casting thicker material (slitter can pull up to 0.160 in its current state) | Acceptable |

TABLE 1-continued

| Trial | Sb Amount | Speed (fpm) | Thickness (in) | Bath Temp (F.) | Tundish (F.) | Lip Temp (F.) | Water Temp (F.) | Results/Comments | Overall Strip Quality |
|---|---|---|---|---|---|---|---|---|---|
| 49 | 5% | 30 | 0.162 | 612 | 590 | 680 | 180 | No cracking, good surface quality | Acceptable |
| 50 | 5% | 35 | 0.145 | 612 | 590 | 680 | 180 | No cracking, good surface quality | Acceptable |
| 51 | 5% | 40 | 0.132 | 612 | 590 | 680 | 180 | No cracking, good surface quality | Acceptable |
| 52 | 5% | 50 | 0.112 | 612 | 590 | 680 | 180 | No cracking, good surface quality | Acceptable |
| 53 | 5% | 60 | 0.098 | 612 | 590 | 680 | 180 | No cracking, good surface quality | Acceptable |
| 54 | 5% | 70 | 0.100 | 590 | 575 | 680 | 195 | No cracking, good surface quality | Acceptable |

Figure 3:
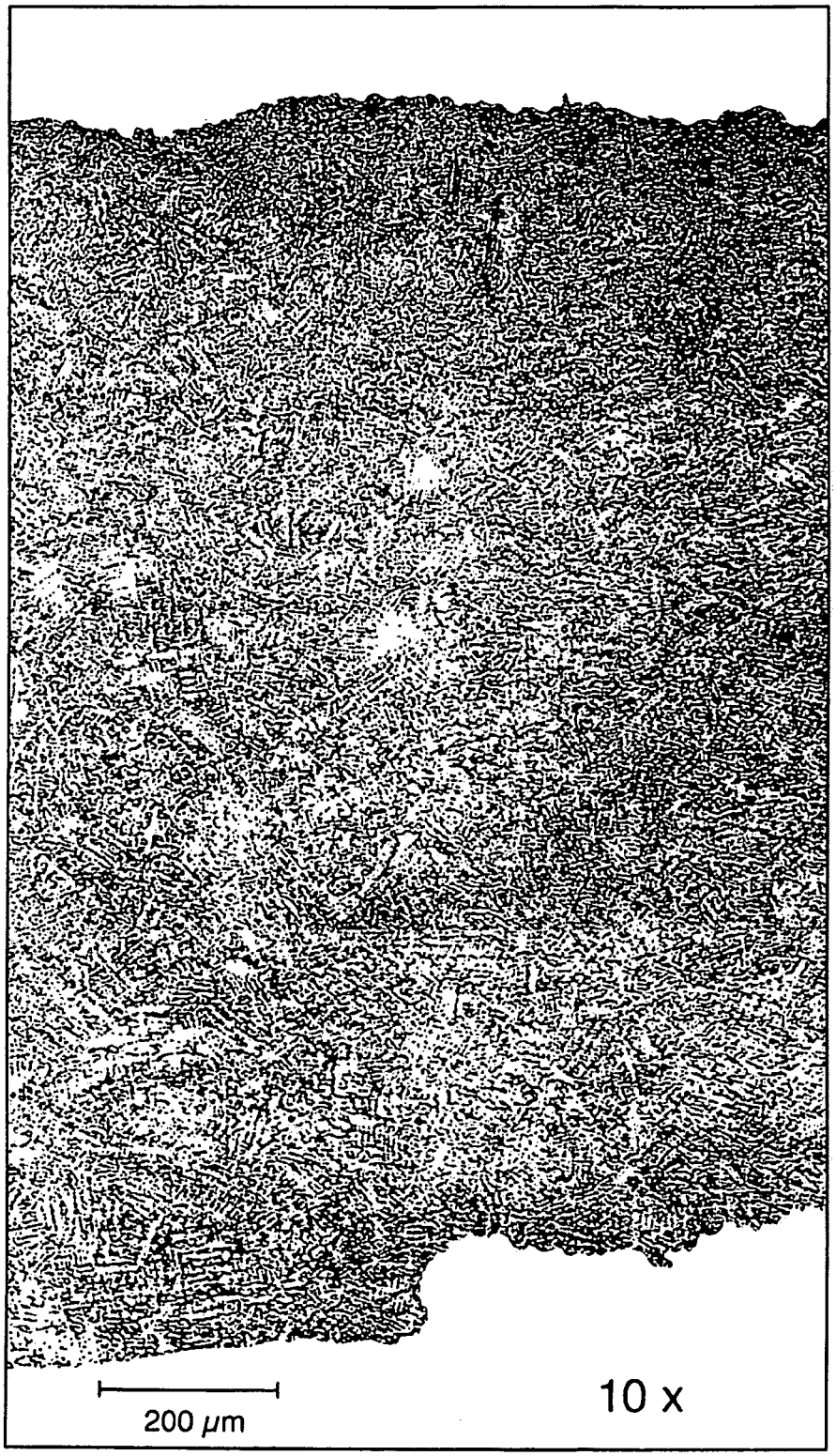
FIG. 3 is a microphotograph of antimony-lead alloy having 5 wt % antimony produced by the method of the invention.

FIG. 3 is microphotograph of a lead-antimony alloy having 5 wt % antimony produced with a thickness of 0.162" at 30 ft/min according to the method of the invention. The grain size ranged from 35 μm to 70 μm, with no visible porosity.

For calcium alloys of lead containing about 0.03 wt % to 0.1 wt % calcium, a furnace temperature of about 750° F., a tundish temperatures of about 700° F., a lip insert temperature of about 750° F., and drum cooling water temperature in the range of about 100 to 210° F. preferably about 125 to 140° F., proved satisfactory.

The present invention provides a number of important advantages. Thick antimony-lead alloy strip free of cracks can be produced in increased width at thicknesses up to at least about 0.185", limited only by the power of the slitter pull rollers to pull the strip from the casting drum, suitable for use as heavy-duty industrial positive electrodes, at commercial line speeds of up to 135 ft/min compatible with downstream operations and processing including, punching and slitting for use in batteries. The strip thickness at 0.185" is about three times the thickness of continuously cast strip heretofore possible, while retaining optimum metallurgical characteristics of a fine grain with essentially no porosity and free of longitudinal cracks. Subsequent heat treatment previously necessary as a post-casting step to acquire desired metallurgical characteristics is obviated, thereby simplifying the casting process and minimizing equipment requirements.

It will be understood that other embodiments and examples of the invention will be readily apparent to a person skilled in the art, the scope and purview of the invention being defined in the appended claims.

The invention claimed is:

1. An apparatus for direct casting of strip from a pool of molten metal comprising:

a rotatable casting drum having cooling passages for the flow of cooling fluid therethrough, the rotatable casting drum including a chilled casting surface;

a tundish including a feed chamber, a return chamber and a diverting chamber having passageways in communication with said chambers in sequence, said tundish having an open front in proximity to a substantially vertical portion of the casting surface;

a lip insert formed from graphite having a floor and opposed sidewalls adapted to be inserted into the tundish adjacent the tundish open front, said lip insert having an open front defined by the lip insert floor and sidewalls for cooperation with the casting surface to contain a pool of said molten metal having a surface level within the lip insert, said pool being in pressure communication with the diverting chamber whereby the surface level of the pool in the lip insert is the same as a surface level of molten metal in the diverting chamber;

a control mechanism configured to control the surface level of the pool of said molten metal in the diverting chamber to control the surface level in the lip insert; and a moving mechanism configured to move the chilled casting surface upwardly through the pool of molten metal for the casting of metal on the chilled casting surface, wherein the chilled casting surface is an outer circumferential surface of a cylindrical drum having a longitudinal axis about which the casting surface rotates and the said casting surface has material worn away creating a coarse irregular surface formed thereon by biasing with crushed, angular silicon carbide or aluminum silicate.

2. The apparatus of claim 1, wherein the control mechanism comprises an adjustable weir positioned in the diverting chamber and configured to direct flow of molten metal into the return chamber and into the lip insert.

3. The apparatus of claim 1, wherein the tundish has sidewalls, the sidewalls of the tundish being the same height as the sidewalls of the lip insert.

4. The apparatus of claim 1, wherein the tundish sidewalls and the lip insert sidewalls have a height of approximately 6.5 inches.

5. The apparatus of claim 1, wherein the cylindrical drum is positioned adjacent the lip insert open front and the tundish open front such that molten metal from the lip insert can be deposited on substantially all of an upper quadrant of the cylindrical drum.

6. The apparatus of claim 1, further comprising:

a secondary drum positioned adjacent the cylindrical drum; and a scraper plate adjacent a juncture of the secondary drum and the cylindrical drum, the scraper plate being configured to peel a lead alloy strip off the casting surface of the cylindrical drum.

7. The apparatus of claim 6, wherein the secondary drum and the scraper plate are positioned such that lead alloy deposited on the cylindrical drum remains on substantially all of the upper half of the cylindrical drum before being removed by the scraper plate.

8. The apparatus of claim 1, further comprising an adjustment mechanism configured to adjust the position of the tundish and the lip insert relative to the cylindrical drum.

9. The apparatus of claim 8, wherein the adjustment mechanism comprises a biasing member configured to bias the tundish toward the cylindrical drum.

10. An apparatus for continuously casting a lead alloy strip, the apparatus comprising:

a tundish having a bottom, opposed sidewalls, and an open front;

a lip insert configured for removable attachment to the tundish, the lip insert having a floor, opposed sidewalls, and an open front, the lip insert and the tundish being configured to contain molten lead alloy for casting a lead alloy strip; and an abraded casting surface having material worn away creating a coarse and irregular surface texture configured to be moved upwardly adjacent the lip insert open front and the tundish open front for depositing molten lead alloy from the tundish and the lip insert onto the abraded casting surface to cast a lead alloy strip.

11. The apparatus of claim 10, wherein the abraded casting surface has a coarse irregular surface formed thereon by biasing with crushed, angular silicon carbide or aluminum silicate.

12. The apparatus of claim 10, wherein the lip insert sidewalls and the tundish sidewalls are the same height.

13. The apparatus of claim 12, wherein the lip insert sidewalls and the tundish sidewalls have a height of approximately 6.5 inches.

14. The apparatus of claim 10, further comprising a rotatable drum, the abraded casting surface being an outer circumferential surface of the rotatable drum.

15. The apparatus of claim 14, wherein the rotatable drum is positioned adjacent the lip insert open front and the tundish open front such that molten lead alloy from the tundish and lip insert can be deposited on substantially all of an upper quadrant of the rotatable drum.

16. The apparatus of claim 14, further comprising:

a secondary drum positioned adjacent the rotatable drum; and a scraper plate adjacent a juncture of the secondary drum and the rotatable drum, the scraper plate being configured to peel a lead alloy strip off the abraded casting surface of the rotatable drum.

17. The apparatus of claim 16, wherein the secondary drum and the scraper plate are positioned with respect to the tundish and rotatable drum such that lead alloy is disposed on substantially all of the upper half of the rotatable drum.

18. The apparatus of claim 14, further comprising an adjusting mechanism configured to adjust the position of the tundish and the lip insert relative to the rotatable drum.

19. The apparatus of claim 18, wherein the adjusting mechanism comprises a biasing member configured to bias the tundish toward the rotatable drum.

20. An apparatus for continuously casting a lead alloy strip, the apparatus comprising:

a tundish having a bottom, opposed sidewalls, and an open front;

a lip insert configured for attachment to the tundish, the lip insert having a floor, opposed sidewalls, and an open front, the lip insert and the tundish being configured to contain molten lead alloy for casting a lead alloy strip;

a primary rotatable drum configured to rotate about an axis;

a casting surface on the primary rotatable drum configured to be moved upwardly adjacent the lip insert open front and the tundish open front for depositing molten lead alloy from the tundish and the lip insert onto the casting surface to cast a lead alloy strip;

a secondary rotatable drum positioned adjacent the primary rotatable drum, the lip insert and the secondary rotatable drum being disposed on opposite sides of a vertical plane including the axis of the primary rotatable drum; and a scraper plate disposed adjacent a nip of the secondary rotatable drum with the primary rotatable drum for peeling the lead alloy strip off of the primary rotatable drum.

* * * * *